United States Patent [19]

Gardner

[11] 3,973,701

[45] Aug. 10, 1976

[54] FOAM GENERATING AND DISPENSING DEVICE

[75] Inventor: Jack C. Gardner, College Park, Ga.

[73] Assignee: Glasrock Products, Inc., Atlanta, Ga.

[22] Filed: June 6, 1975

[21] Appl. No.: 584,609

[52] U.S. Cl. ..... 222/190; 222/479

[51] Int. Cl.[2] ..... B67D 5/58; B67D 3/00

[58] Field of Search ..... 222/190, 479

[56] References Cited

UNITED STATES PATENTS

| | | | |
|---|---|---|---|
| 2,752,199 | 6/1956 | Newell, Jr. | 222/211 X |
| 3,428,222 | 2/1969 | Wright | 222/187 |
| 3,474,936 | 10/1969 | McDonnell | 222/211 |
| 3,622,049 | 11/1971 | Thompson | 222/190 |
| 3,709,437 | 1/1973 | Wright | 239/343 |

FOREIGN PATENTS OR APPLICATIONS

| | | |
|---|---|---|
| 679,400 | 12/1964 | Italy |

*Primary Examiner*—Allen N. Knowles
*Assistant Examiner*—Hadd Lane
*Attorney, Agent, or Firm*—Lane, Aitken, Dunner & Ziems

[57] ABSTRACT

A foam producing and dispensing device for use with a deformable bottle containing foamable liquid and air, the device including cap means adapted to be fixed to the bottle mouth and defining a discharge passage in communicating relation therewith, a mixing chamber with an inlet at its lower end in communication with a dip tube depending below the level of foamable liquid in the bottle, air inlet passage elevated above the level of liquid in the bottle, a check valve in the mixing chamber inlet, a foam homogenizing element in the outlet of the mixing chamber and means providing for a one-way return air inlet to the bottle after collapse thereof to force the foamable liquid and air into the mixing chamber and deliver foam from the discharge passage. The one-way valve control for the air return inlet passages is in the form of a simple elastomeric washer press fit over the exterior of the mixing chamber.

2 Claims, 3 Drawing Figures

FOAM GENERATING AND DISPENSING DEVICE

BACKGROUND OF THE INVENTION

This invention relates to foam producing and dispensing apparatus and more particularly, it concerns an improved cap assembly attachable to the mouth of a collapsible bottle containing foamable liquid and air and by which the foam producing and dispensing operation of such apparatus is materially enhanced.

In U.S. Pat. No. 3,709,437 issued Jan. 9, 1973 to H. E. Wright, there is disclosed a method and apparatus for producing and dispensing foam in which a collapsible reservoir or bottle containing foamable liquid and air is fitted with a cap assembly supporting within the bottle mouth a mixing chamber having air inlet passages elevated above the liquid in the bottle and having a check valve controlled inlet in communication with a dip tube depending below the level of foamable liquid in the bottle. The mixing chamber opens at its upper end through a porous homogenizing element to a dispensing outlet carried by the cap. The device operates such that upon collapsing deformation of the bottle, both foamable liquid and air within the bottle are forced into the mixing chamber to produce foam which is passed directly to the discharge passage.

Foam producing and dispensing devices of the type disclosed in the aforementioned U.S. patent have proven highly effective in the instantaneous generation and dispensing of a highly consistent and relatively dry foam. Some difficulty has been evidenced, however, in achieving a rapid return of air back into the bottle as required for repeated foam generation and dispensing cycles. In the prior devices, the return of air to the interior of the bottle after a dispensing operation was directly through the passages by which air was introduced from the bottle interior into the mixing chamber. Inasmuch as the upper region of the chamber and discharge passage are filled with foam during this phase of the operation, the residual foam in the discharge port and the homogenizing element restrict the return of air into the bottle upon restoration thereof to its original configuration.

Although the restriction presented by the homogenizing element is circumvented in at least one embodiment disclosed in the aforementioned patent by allowing the homogenizing element to be advanced upwardly against the peripheral seal during the discharge of foam from the device and to drop inwardly to a position in which air flow about the homogenizing element is permitted, the restriction represented by residual foam in the discharge nozzle is not in any way accounted for. In addition, the provision for floating movement of the homogenizing element represents an increment of increased manufacturing costs in the device.

SUMMARY OF THE PRESENT INVENTION

In accordance with the present invention, the desirable foam producing and dispensing attributes of the prior art are retained while at the same time improving overall operation of the device with a relatively inexpensive cap assembly provided with a valved air return passage to enable immediate return of the collapsible bottle to its initial state. In particular, one or more inlet passages are provided about an annular portion of the cap between the mixing chamber and the threaded skirt by which the cap is attached to the bottle. One-way valving for the ports is provided by an inexpensive and easily assembled elastomeric disc or washer arranged concentrically about the mixing chamber and underlying the inside of the air return passages.

Accordingly, among the objects of the present invention are: the provision of an improved cap assembly for attachment to a collapsible bottle containing a foamable liquid and air for use in the production and dispensing of foam; the provision of such an improved cap assembly by which air is returned to the bottle through an essentially unobstructed passage externally of the foam discharge passage to enable instantaneous return of the bottle to its uncollapsed condition; the provision of such a cap assembly which is highly effective in operation and yet which is easily assembled; and the provision of such a cap assembly which is capable of low-cost manufacture without compromise of operating efficiency.

Other objects and further scope of applicability of the present invention will become apparent from the detailed description to follow taken in conjunction with the accompanying drawings in which like reference numerals designate like parts.

DETAILED DESCRIPTION OF THE PREFERRED EMBODIMENT

Figure 1:
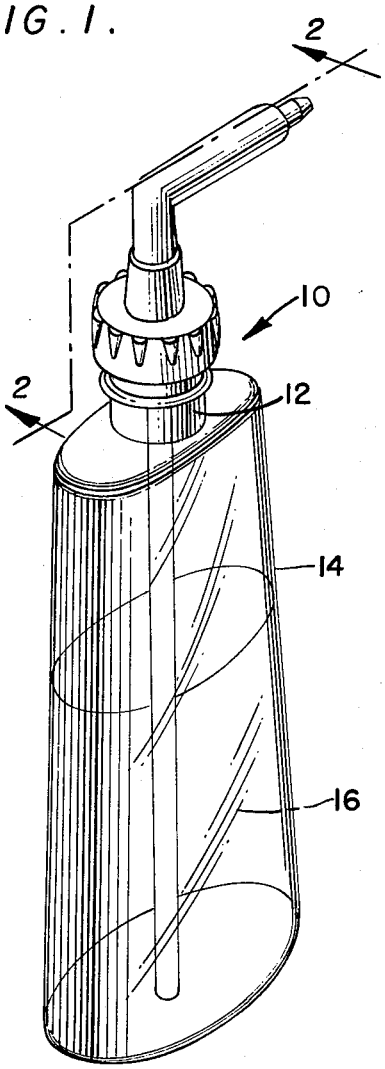
FIG. 1 is a perspective view illustrating the foam producing and dispensing apparatus of the invention.

As shown in the drawings, the improved cap assembly for foam producing and discharging apparatus in accordance with the present invention is generally designated by the reference numeral 10 and fixed to the mouth 12 of a collapsible bottle 14 partially filled with foamable liquid 16 and air above the level of liquid in the bottle. The cap assembly 10 parallels the prior art to the extent that it includes an internally threaded skirt 18 for attachment to external threads on the mouth 12 of the bottle and supports means establishing a mixing chamber 20 having a ball check valve controlled liquid inlet 22, an imperforate depending dip tube 24, air inlet ports 26, and a homogenizing element 28 in an upper outlet communicating with a discharge passage 30. The development and dispensing of foam also in accordance with the teachings of the prior art, is effected by collapsing deformation of the bottle 14 causing liquid to flow upwardly through the dip tube 24 into the mixing chamber 20 along with air through the ports 26 and to cause foam to be dispensed through the homogenizing element 28 and the discharge passage 30. The ball check 32 retains the level of foamable liquid in the dip tube for subsequent discharging compression of the bottle.

In accordance with the present invention, the mixing chamber 20 is formed essentially by a cylindrical wall portion 34 depending from a sealing disc or washer 36 having a planar bottom surface 38 to seat firmly against the upper lip of the bottle mouth 12. The lower end of the wall 34 is joined by an annular portion 39 with a socket 40 for receiving the homogenizing element 28, which in the disclosed embodiment is of an inverted cup-shaped configuration. The socket 40 tapers to a neck 41 forming the inlet 22 and having an outside diameter of a size to facilitate a telescopic press fit connection with the upper end of the dip tube 24. The tapered portion between the socket 40 and the neck 41 accommodates the air inlet apertures 26 and also provides a seat for the ball check 32.

The upper surface of the washer 36 is provided near its outer edge with an upstanding circular rib 42, which when engaged by the undersurface of the cap 18 aids in holding the washer 36 firmly against the upper lip of the bottle mouth 12. In addition, the upstanding circular ridge 42 retains the lower surface of the cap in spaced relation to the upper surface of the washer 36 to establish an annular air passage 44. As may be seen in FIG. 2 of the drawings, the cap 18 is essentially an integrated molded component with a conduit 46 extending coaxially and upwardly therefrom to establish the discharge passage 30. The conduit is formed with a right angle juncture and receives in its terminal end an extensible or telescopic nozzle 48. Further, the conduit portion of the cap terminates at its lower end in a depending circular lip 50 adapted to seat firmly against the upper surface of the washer 36. The lip 50 thus seals the annular air passage 44 from fluid communication with the mixing chamber 20 and discharge passage 30.

Figure 2:
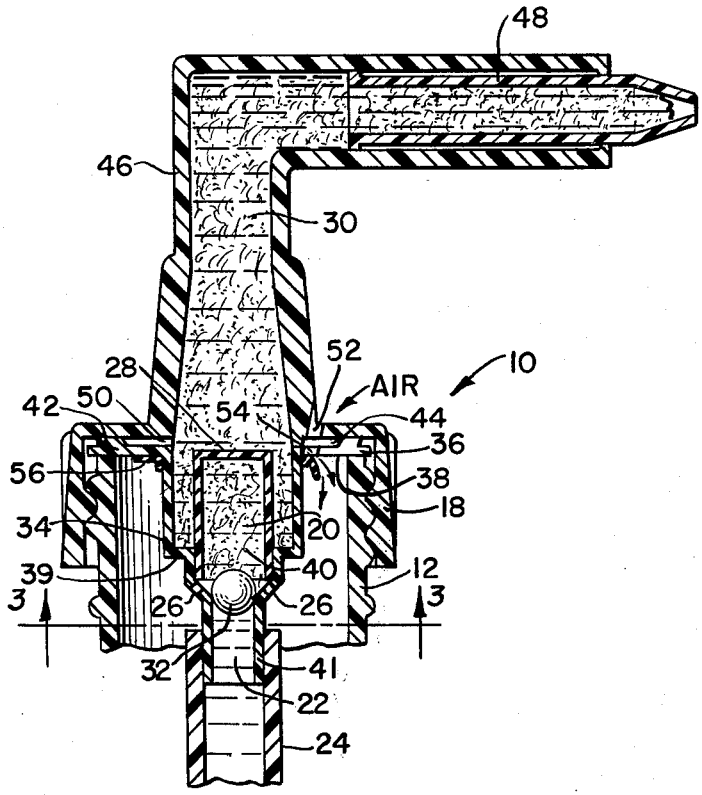
FIG. 2 is an enlarged fragmentary cross-section taken on line 2—2 of FIG. 1.
Figure 3:
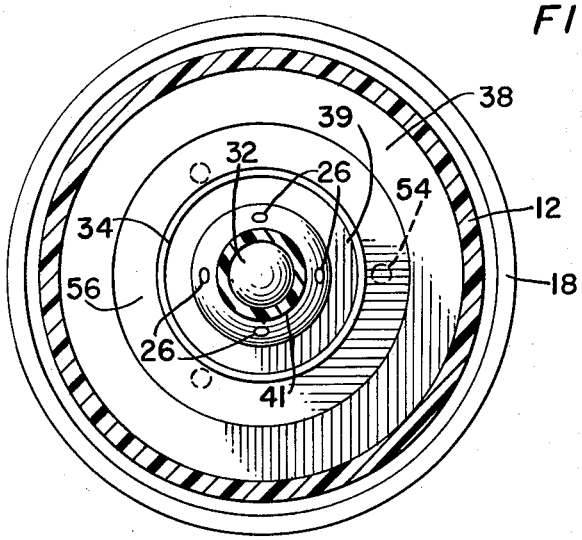
FIG. 3 is a further enlarged cross-section taken on line 3—3 of FIG. 2.

In accordance with an important feature of the present invention, both the cap 18 and the washer 36 are provided with one or more apertures 52 and 54 respectively, there being three of each such apertures in the illustrated embodiment. Although the apertures 52 and 54 are shown as aligned with each other in the drawing, it will be appreciated that because the washer 36 and cap are independently rotatable, misalignment of the ports 52 and 54 is likely to occur. Because of the annular air passage 44, however, such misalignment in no way interferes with the establishment of an independent air passage from the exterior of the cap through the bottle mouth 12 in the annulus defined therewith by the wall 34. Also, a check valve preventing discharge of air from the bottle interior through the passages 52 and 54 is established by an elastomeric washer 56 having a central aperture initially smaller than the exterior diameter of the depending wall 34 so that it may be pressed into a slightly L-shaped radial cross-sectional configuration as shown in FIG. 2 for example.

In operation of the device to generate and dispense foam in the manner described briefly above, collapsing deformation of the bottle 14 to discharge foam will occur without passage of air through the ports 52 and 54 due to the blockage in this direction provided by the elastomeric check valve 56. The check valve 32 during this operation, will be lifted from the seat defined by the conical portion 26. When the force collapsing the bottle is released to effect a negative pressure within the bottle, the check valve 56 will be deformed to the state illustrated in FIG. 2 of the drawings allowing a free flow of air through the ports 52 and 54 into the bottle. In light of this operation, it will be appreciated that foam generating and dispensing cycles may be repeated rapidly without any delay incurred as a result of waiting for air to be returned to the bottle interior.

In addition to the enhanced operation effected by the present invention, the ease with which the cap assembly 10 may be assembled will also be appreciated. In particular, the assembly of the ball check 32 and the homogenizing element 28 in the mixing chamber 20 involves merely placement of these members directly into the upper end of the chamber. The elastomeric washer 56 is simply pushed over the exterior of the cylindrical wall and the dip tube telescopically assembled with the inlet neck portion 40. This subassembly is inserted onto the mouth of the bottle and the cap screwed on in conventional fashion to retain the overall assembly in operative condition. Thus it will be seen that by this invention, there is provided an improved foam generating and dispensing cap assembly which enhances the foam generating and dispensing operation, facilitates low-cost manufacturing techniques, and by which the above-mentioned objectives are completely fulfilled.

It is contemplated that modifications may be made in the disclosed embodiment without departing from the inventive concept manifested by that embodiment. It is expressly intended, therefore, that the foregoing description is illustrative of a preferred embodiment only, not limiting, and that the true spirit and scope of the present invention be determined by reference to the appended claims.

I claim:

1. In a foam producing and dispensing device for use with a deformable bottle containing foamable liquid and air, the device including cap means having an internally threaded depending skirt portion for attachment to external threads on the bottle mouth, a central upstanding conduit portion defining a discharge passage in communicating relation with the bottle and an annular surface between the discharge portion and the skirt, a mixing chamber with an inlet at its lower end in communication with a dip tube depending below the level of foamable liquid in the bottle, the mixing chamber being formed by a depending cylindrical wall portion in a sealing washer separate from the cap, air inlet passages through said cylindrical wall portion elevated above the level of liquid in the bottle, a check valve in the mixing chamber inlet and a foam homogenizing element in an outlet at the upper end of the mixing chamber and in communication with the discharge passage, the device being operative on collapsing deformation of the bottle to force the foamable liquid and air into the mixing chamber and deliver foam through the discharge passage, the improvement comprising:

means defining a separate air return inlet through the cap means externally of the mixing chamber to establish direct fluid communication between the atmosphere and the bottle interior, said return air inlet defining means including a pair of continuous inner and outer rib projections extending between said sealing washer and the annular surface of the cap thereby to establish an annular space between said ribs, the cap and said sealing washer isolated from fluid communication with the mixing chamber and the discharge passage, the cap and said washer respectively having apertures formed therein in communication with said annular space; and means defining a one-way valve operative to present the discharge of fluid from the bottle interior through said apertures in the sealing washer and thus through said air return inlet and to open said air return inlet on a reduction of pressure in the bottle to less than that of the atmosphere.

2. The apparatus recited in claim 1 wherein said one-way valve defining means comprises an elastomeric washer pressed over the exterior of said depending cylindrical wall portion to underlie the apertures formed in said sealing washer.

* * * * *